US008708464B2

(12) United States Patent
Kushida et al.

(10) Patent No.: US 8,708,464 B2
(45) Date of Patent: Apr. 29, 2014

(54) INK JET HEAD AND METHOD OF MANUFACTURING THE INK JET HEAD

(75) Inventors: Hiroyuki Kushida, Kanagawa (JP); Nobuaki Murochi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 70 days.

(21) Appl. No.: 13/409,317

(22) Filed: Mar. 1, 2012

(65) Prior Publication Data

US 2012/0229579 A1 Sep. 13, 2012

(30) Foreign Application Priority Data

Mar. 9, 2011 (JP) ..... 2011-051709

(51) Int. Cl.
*B41J 2/015* (2006.01)

(52) U.S. Cl.
USPC ..... 347/68

(58) Field of Classification Search
None
See application file for complete search history.

(56) References Cited

U.S. PATENT DOCUMENTS

2009/0303294 A1* 12/2009 Asako ..... 347/68

FOREIGN PATENT DOCUMENTS

| | | |
|---|---|---|
| JP | 2006-044242 | 2/2006 |
| JP | 2007-190892 | 8/2007 |
| JP | 2007-320187 | 12/2007 |
| JP | 2008-162111 | 7/2008 |
| JP | 2009-119788 | 6/2009 |
| JP | 2009-196122 | 9/2009 |
| JP | 2009202473 A * | 9/2009 |

OTHER PUBLICATIONS

Japanese Office Action for Japanese Patent Application No. 2011-051709 mailed on Aug. 20, 2013.

* cited by examiner

*Primary Examiner* — Matthew Luu
*Assistant Examiner* — Erica Lin
(74) *Attorney, Agent, or Firm* — Amin, Turocy & Watson, LLP

(57) ABSTRACT

According to one embodiment, an ink jet head includes: a nozzle plate including plural nozzles; a piezoelectric element including plural pressure chambers corresponding to the nozzles and sidewalls provided adjacent to the pressure chambers and functioning as driving elements that press the pressure chambers to eject liquid from the nozzles; a substrate to which the piezoelectric element is bonded; a frame member placed on the substrate to surround the piezoelectric element; and electrodes for driving the piezoelectric element. The piezoelectric element includes slopes continuous to the upper end of the piezoelectric element and not in contact with the nozzle plate. The substrate has a surface layer formed on the surface thereof and includes recess continuous to the slopes in the surface layer. The electrodes are formed on the slopes and the recess.

6 Claims, 3 Drawing Sheets

INK JET HEAD AND METHOD OF MANUFACTURING THE INK JET HEAD

CROSS-REFERENCE TO RELATED APPLICATION

This application is based upon and claims the benefit of priority from the prior Japanese Patent Application No. 2011-051709 filed on Mar. 9, 2011, the entire contents of which are incorporated herein by reference.

FIELD

Embodiments described herein relate generally to an ink jet head and a method of manufacturing the ink jet head.

BACKGROUND

An ink jet head used in an ink jet printer includes an insulating substrate formed of a ceramic material, a nozzle plate arranged to be opposed to the insulating substrate, a driving element arranged to be stacked between the insulating substrate and the nozzle plate, a frame member made of a ceramic material that surrounds the driving element to form a common liquid chamber and pressure chambers.

The driving element includes a pair of piezoelectric elements made of a PZT (lead titanate zirconate) piezoelectric ceramic material. The driving element is driven by a driving circuit. An electrode pattern that makes the driving element and the driving circuit conductive is formed on the insulating substrate. Taper surfaces are formed on both end faces of the driving element.

In the ink jet head in the past, the electrode pattern that makes the driving element and the driving circuit conductive is formed on the insulating substrate. An electrode is formed by, for example, well-known electroless plating. For the electroless plating, chemical pretreatment such as adsorption of catalytic cores is necessary. The electrode pattern is formed to extend from the driving element to the insulating substrate. Therefore, the piezoelectric element and the insulating substrate are simultaneously subjected to the electroless plating.

Therefore, it is requested that the surfaces of the piezoelectric element and the insulating substrate have similar characteristics with respect to the chemical pretreatment. If chemical characteristics of the surfaces of the piezoelectric element and the insulating substrate are substantially different, a difference occurs in deposition of a plating film and the plating film peels in a later process.

Further, since the electrode pattern having thickness of several tens micrometers is drawn around on the surface of the insulating substrate, smoothness and absence of an air gap are also requested. If the smoothness is poor and the air gap is present, the electrode pattern is inadvertently open.

Moreover, after the piezoelectric element is joined to the insulating substrate, if the end faces of the driving element are mechanically tapered, the insulating substrate side is also machined. However, if mechanical characteristics of the surfaces of the piezoelectric element and the insulating substrate are substantially different, cracks and chips occur in the piezoelectric element and the insulating substrate.

On the other hand, because of the request for a reduction in cost of the ink jet head, it is desirable that even an insulating substrate that has less satisfactory smoothness and in which a large number of air gaps are present can be used.

DETAILED DESCRIPTION

Figure 1:
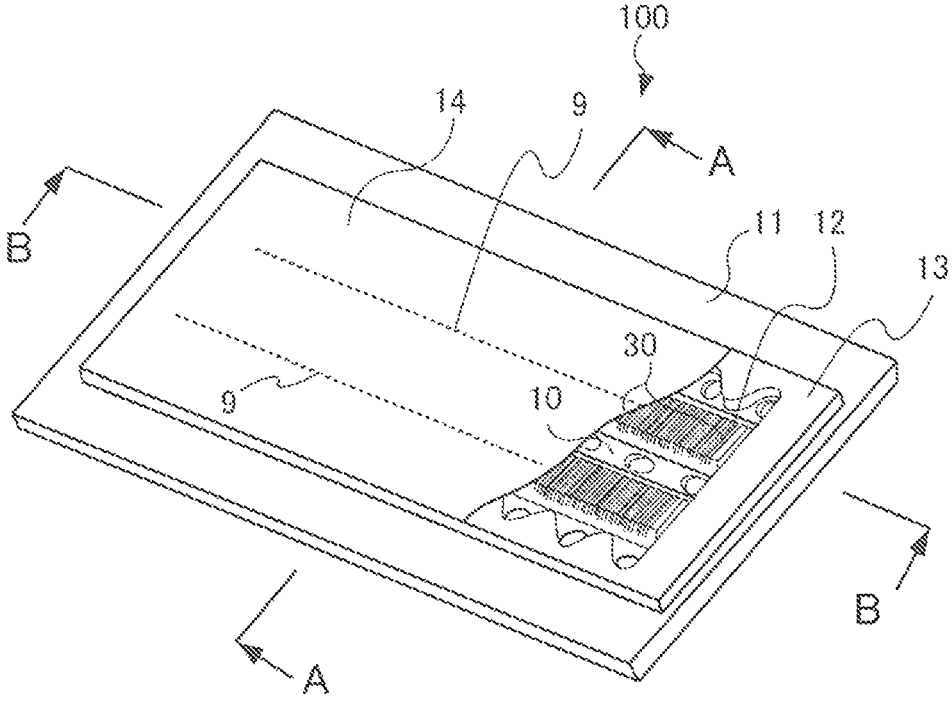
FIG. 1 is a diagram of the configuration of an ink jet head according to an embodiment.

In general, according to one embodiment, an ink jet head includes: a nozzle plate including plural nozzles; a piezoelectric element including plural pressure chambers corresponding to the nozzles and sidewalls provided adjacent to the pressure chambers and functioning as driving elements that press the pressure chambers to eject liquid from the nozzles; a substrate to which the piezoelectric element is bonded; a frame member placed on the substrate to surround the piezoelectric element; and electrodes for driving the piezoelectric element. The piezoelectric element includes slopes continuous to the upper end of the piezoelectric element and not in contact with the nozzle plate. The substrate has a surface layer formed on the surface thereof and includes recess continuous to the slopes in the surface layer. The electrodes are formed on the slopes and the recess.

An embodiment is explained below with reference to the accompanying drawings. In the figures, the same components are denoted by the same reference numerals and signs and redundant explanation of the components is omitted.

Configuration of an Ink Jet Head According to the Embodiment

FIG. 1 is a diagram of the configuration of an ink jet head 100 according to the embodiment. As shown in FIG. 1, the ink jet head 100 includes an insulative substrate 11 formed of a dielectric, piezoelectric elements 12 placed on the substrate 11 and having engraved therein pressure chambers including spaces and conductor layers, a frame member 13 placed on the substrate 11 to surround the piezoelectric elements 12, and a nozzle plate 14 bonded to the upper ends of side walls of the piezoelectric elements 12 and having nozzle rows 9.

The substrate 11 is formed of, for example, alumina. As another material of the substrate 11, an insulative material such as glass epoxy resin can also be used.

The ink jet head 100 includes two rows of the piezoelectric elements 12 on the substrate 11. The piezoelectric elements 12 are formed of PZT (zinc titanate zirconate). As another material of the piezoelectric elements 12, PTO (PbTiO3: lead titanate), PMNT (Pb(Mg1/3Nb2/3)O3-PbTiO3; lead magnesate niobate), PZNT (Pb(Zn1/3Nb2/3)O3-PbTiO3), ZnO, or the like can also be used.

The nozzle plate 14 is formed of a resin film of polyimide or the like. On the surface on an ink droplet ejection side of the nozzle plate 14, a water repellent film (not shown) is formed of, for example, fluorine resin. As another material of the nozzle plate 14, a nickel plate or a silicon plate can also be used.

Each of the nozzle rows 9 includes plural nozzle holes 15. The nozzle holes 15 function as ejection holes for ink droplets and are formed at an equal interval.

Figure 2:
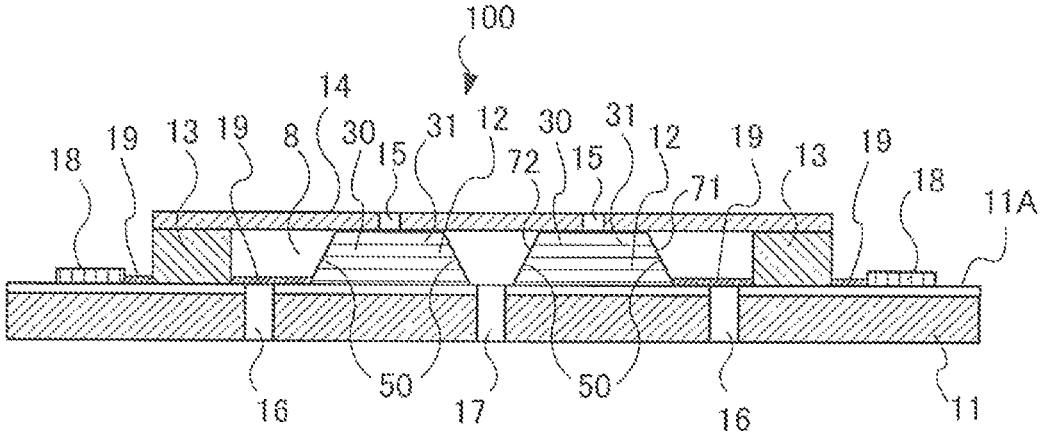
FIG. 2 is a sectional view taken along line A-A in FIG. 1 of the ink jet head according to the embodiment.

FIG. 2 is a sectional view taken along line A-A in FIG. 1 of the ink jet head 100 according to this embodiment. As shown in FIG. 2, the ink jet head 100 includes ink suction holes 16 and ink discharge holes 17 in the substrate 11. Ink circulates through the ink suction holes 16, pressure chambers 30, and the ink discharge holes 17. The pressure chambers 30 include spaces and conductor layers on the inside thereof. An ink chamber 8 surrounded by the substrate 11, the frame member 13, and the nozzle plate 14 is formed.

A surface layer 11A formed of PZT is formed on the surface of the substrate 11 at thickness of 50 μm. The piezoelectric elements 12 are joined on the surface layer 11A. In this case, the configuration of the substrate 11/the surface layer 11A/the piezoelectric elements 12 is alumina/PZT/PZT. As another material forming the surface layer 11A, alumina, PTO, PMNT, PZNT, ZnO, or the like can also be used.

Further, sidewalls of the pressure chambers 30 of the piezoelectric elements 12 assume a trapezoidal shape in section. The nozzle plate 14 includes nozzle holes 15 above the pressure chambers 30.

The ink jet head 100 includes, on the outer side of the frame member 13, driver ICs 18 that drive the piezoelectric elements 12 and electrodes 19 that connect the driver ICs 18 and the piezoelectric elements 12. The electrodes 19 are wired on the surface layer 11A of the substrate 11. The piezoelectric elements 12 driven by the driver ICs 18 are deformed, whereby the ink jet head 100 ejects the ink. Specifically, the pressure chambers 30 increased in volume lead the ink into the inside thereof and the pressure chambers 30 reduced in volume eject the pressurized ink from the nozzle holes 15.

Figure 3:
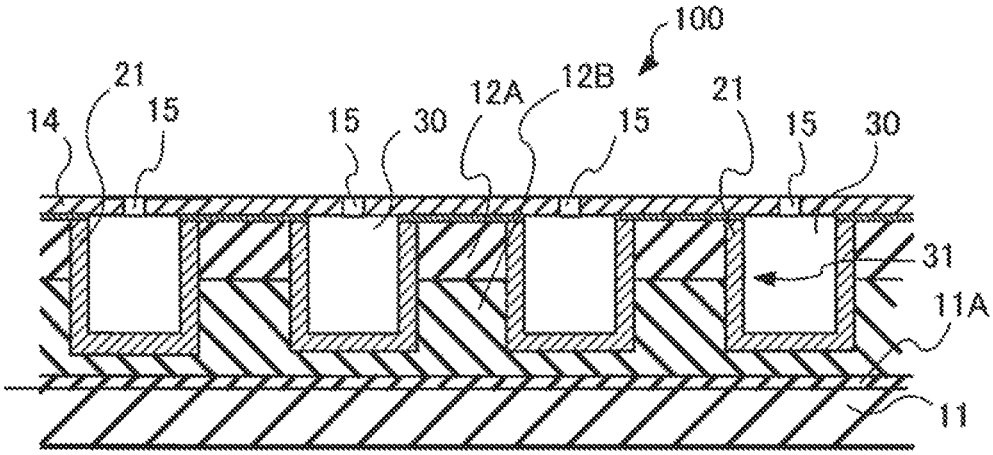
FIG. 3 is a sectional view taken along line B-B in FIG. 1 of the ink jet head according to the embodiment.

FIG. 3 is a sectional view taken along line B-B in FIG. 1 of the ink jet head 100 according to this embodiment. As shown in FIG. 3, the ink jet head 100 includes a first piezoelectric element 12B on the surface layer 11A of the substrate 11 in a comb teeth shape in which projections and recess continue. The ink jet head 100 includes, at the upper ends of the projections of the first piezoelectric element 12B, second piezoelectric elements 12A having polarity opposite to that of the first piezoelectric element 12B. The ink jet head 100 includes, at the upper ends of the recess of the first piezoelectric element 12B, conductor layers 21 that cover sidewalls 31 of the pressure chambers 30 in a C shape in section.

In such a structure, regions surrounded by the sidewalls 31, the bottom surfaces of the recess, and the nozzle plate 14 form the plural pressure chambers 30 arranged in a main scanning direction.

Figure 4:
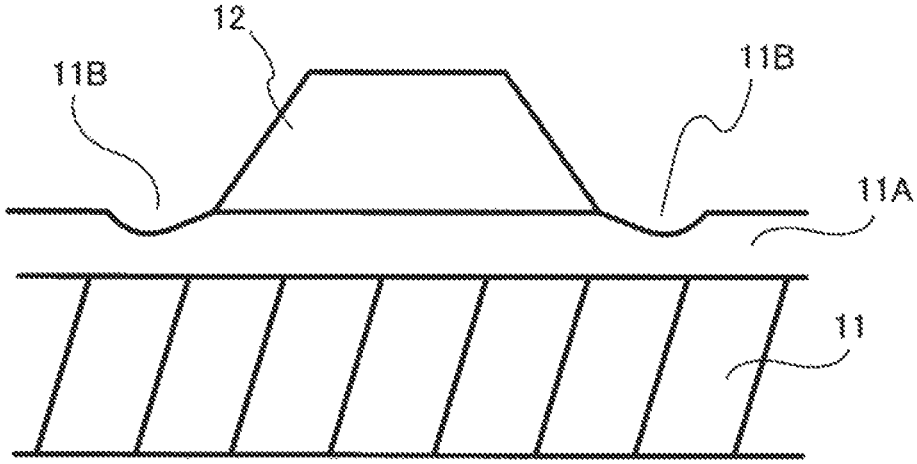
FIG. 4 is an enlarged view of a main part of the ink jet head according to the embodiment.

FIG. 4 is an enlarged view of a cross section of the recess 11B in the surface layer 11A of the substrate 11 of the ink jet head 100 according to this embodiment. The recess 11B is formed to be continuous to the trapezoid of the piezoelectric element 12. The depth of the recess 11B is, for example, 20 μm and smaller than the thickness of the surface layer 11A.

Figure 5:
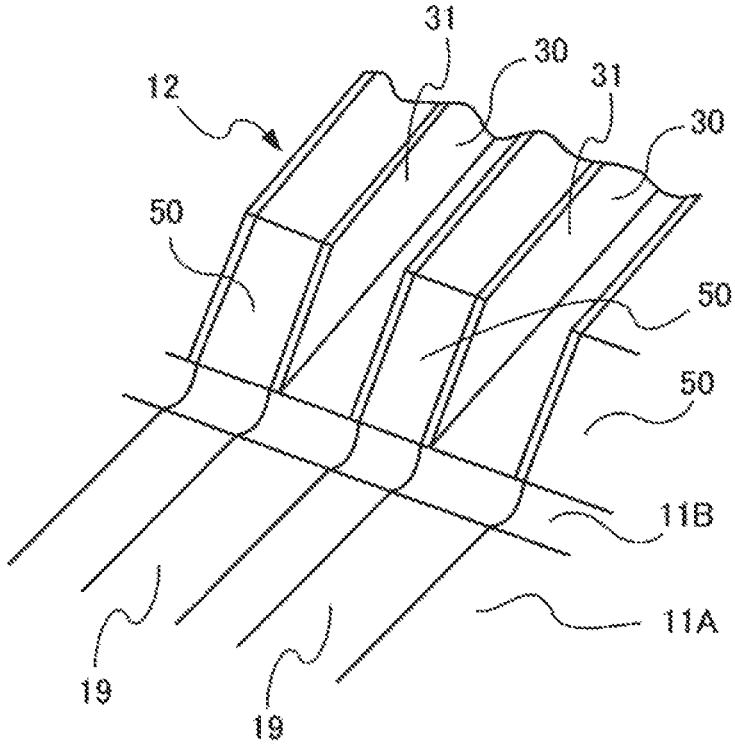
FIG. 5 is an enlarged view of a main part of the ink jet head according to the embodiment.

FIG. 5 is a perspective enlarged view of the recess 11B of the ink jet head 100 according to this embodiment. As shown in FIG. 5, the electrodes 19 are formed by being drawn around on the surface layer 11A including the recess 11B from the pressure chambers 30 of the piezoelectric element 12 among slopes 50 of the piezoelectric element 12.

As explained above, the ink jet head 100 according to this embodiment includes, on the surface of the substrate 11, the surface layer 11A chemically and mechanically having high affinity with the piezoelectric elements 12. The ink jet head 100 includes, on the surface layer 11A, the recess 11B continuous to the slopes 50 of the piezoelectric elements 12 and includes, on the surface layer 11A including the slopes 50 and the recess 11B, the electrodes 19 for driving the piezoelectric elements 12.

Therefore, reliability such as adhesiveness of the electrodes 19 is high. Further, after the piezoelectric elements 12 are joined to the substrate 11, when the end faces of the piezoelectric elements 12 are mechanically tapered, the substrate 11 side is also machined. However, cracks and chips do not occur in the piezoelectric elements 12 and the substrate 11.

Method of Manufacturing the Ink Jet Head According to this Embodiment

A method of manufacturing the ink jet head configured as explained above is explained below.

First, the substrate 11 is prepared. Aerosol containing particulates of a ceramic material such as PZT is sprayed on the surface of the substrate 11 in advance to form the surface layer 11A.

A pair of the first piezoelectric elements 12B and the second piezoelectric elements 12A stuck together are bonded on the substrate 11 having the ink suction holes 16 and the ink discharge holes 17.

Figure 6:
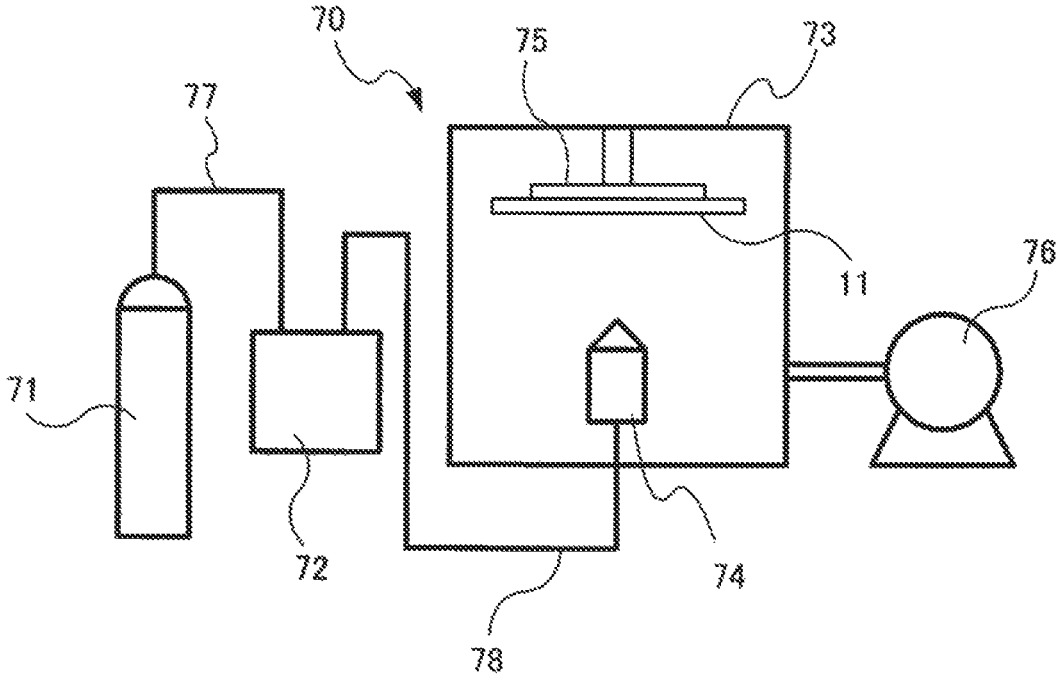
FIG. 6 is a schematic diagram of a film forming apparatus that forms a surface layer.

FIG. 6 is a schematic diagram of a film forming apparatus 70 that forms the surface layer 11A. The film forming apparatus 70 mainly includes a gas cylinder 71 that stores a carrier gas, an aerosol generator 72, a film formation chamber 73, a nozzle 74, a substrate holder 75, and an exhaust pump 76.

The aerosol generator 72 includes an aerosol chamber 72*a* (not shown) that can store material particulates on the inside thereof and a vibrator 72*b* (not shown) that vibrates the aerosol chamber 72*a* (not shown). The aerosol chamber 72*a* (not shown) and the gas cylinder 71 are connected via a lead-in pipe 77. The distal end of the lead-in pipe 77 is located near the bottom surface on the inside of the aerosol chamber 72*a* (not shown) and is arranged to be embedded in ceramic material particulates.

The substrate holder 75 for attaching the substrate 11 and the nozzle 74 are provided in the film formation chamber 73. The nozzle 74 is connected to the aerosol chamber 72*a* (not shown) via a supply pipe 78. Further, the exhaust pump 76 is connected to the film formation chamber 73.

In the film forming apparatus 70 configured as explained above, the ceramic material particulates are thrown into the aerosol generator 72. The substrate 11 is set on the substrate holder 75 of the film formation chamber 73. Subsequently, a carrier gas of an inert gas such as helium is led into the aerosol generator 72 from the gas cylinder 71 through the lead-in pipe 77. The ceramic material particulates are blown up by the lead-in of the carrier gas. The ceramic material particulates and the carrier gas are mixed by the action of the vibrator 72*b* (not shown) and aerosol is generated. The generated aerosol is sprayed at high speed from the nozzle 74 to the substrate 11 through the supply pipe 78. The ceramic material particulates in the aerosol collide against the substrate 11 and are finely crushed and bonded to the substrate 11. The ceramic material particulates join with one another to form the fine surface layer 11A. Since the surface layer 11A has hardness same as that of a ceramic sintered body, heating at high temperature after the formation is unnecessary.

Subsequently, the bonded piezoelectric elements 12 are cut to be formed in a trapezoidal shape in section. At the same time, the surface layer 11A is cut to form the recess 11B. In this way, the recess 11B is formed to be continuous to the trapezoids of the piezoelectric elements 12.

The pressure chambers 30 are cut by, for example, a diamond wheel of a dicing saw.

The conductor layers 21 are formed on the sidewalls 31 of the pressure chambers 30, the slopes 50 of the piezoelectric elements 12, and the surface layer 11A of the substrate 11.

More specifically, layers of Ni or Cu are formed by the electroless plating at the thickness of 0.5 μm to 3 μm on the sidewalls 31 of the pressure chambers 30, the slopes 50 of the piezoelectric elements 12, and the surface layer 11A of the substrate 11. Au layers are formed by the electrolytic plating at the thickness of 0.1 μm. In other words, the top surfaces of the conductor layers 21 are formed of Au.

The conductor layers 21 at the upper ends of the sidewalls 31 of the pressure chambers 30 are removed by chemical etching or mechanically. Further, a laser is irradiated on the slopes 50 of the piezoelectric elements 12 and the surface layer 11A of the substrate 11 to remove unnecessary portions and form the electrodes 19.

The frame member 13 is bonded to the substrate 11. As an adhesive, for example, an epoxy adhesive of a thermosetting type is suitable.

The nozzle plate 14 is boned to the frame member 13 and the upper ends of the sidewalls 31 of the piezoelectric elements 12 using the adhesive. A laser is irradiated on the nozzle plate 14 to perforate the nozzle holes 15.

Alternatively, the nozzle plate 14 having the nozzle holes 15 perforated in advance is bonded to the frame member 13 and the upper ends of the sidewalls 31 of the piezoelectric elements 12 using the adhesive.

As another material of the nozzle plate 14, a nickel nozzle plate or a silicon plate can be used. The nickel nozzle plate is obtained by forming a nickel plate having nozzles with the electroforming and forming a water repellent film on the surface on an ink ejection side. The silicon plate is obtained by forming a monocrystal silicon plate with the anisotropic etching and forming a water repellent film on the surface on an ink ejection side.

The driver ICs 18 are connected to the electrodes 19 of the substrate 11.

An ink case is bonded.

In the method of manufacturing the ink jet head 100 according to this embodiment, the surface layer 11A chemically and mechanically having high affinity with the piezoelectric elements 12 is formed on the surface of the substrate 11 by spraying the aerosol containing the ceramic material particulates on the surface.

According to this embodiment, a fine film can be formed on the surface layer 11A formed by spraying the aerosol containing the ceramic material particulates. Therefore, even a material that has less satisfactory smoothness and in which a large number of air gaps are present can be used as the substrate 11.

Further, since the surface layer 11A has hardness same as that of a ceramic sintered body, heating at high temperature after the formation is unnecessary. Therefore, a material having low heat resistance compared ceramics and the like can also be used as the substrate 11.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An ink jet head comprising:

a nozzle plate including a plurality of nozzles;

a piezoelectric element including a plurality of pressure chambers corresponding to the nozzles, and a sidewall that is provided adjacent to the pressure chambers and is formed with a drive element that applies pressure to the pressure chambers to eject a liquid from the nozzles;

a substrate to which the piezoelectric element is bonded that has an affinity for the piezoelectric element;

a frame member placed on the substrate to surround the piezoelectric element;

an electrode that drives the piezoelectric element, wherein the piezoelectric element has a slope that is continuous with an upper edge section of the piezoelectric element, and is not in contact with the nozzle plate, a surface layer of the substrate that has a recess continuous with the slope, and the electrode is formed on the slope and the recess.

2. The ink jet head according to claim 1, wherein the surface layer is formed of a material selected out of zinc titanate zirconate, alumina, lead magnesate niobate, Pb(Zn1/3Nb2/3)03-PbTi03, and ZnO.

3. The ink jet head according to claim 1, wherein, in the surface layer, the recess is formed to be continuous to a trapezoid of the piezoelectric element.

4. The ink jet head according to claim 3, wherein depth of the recess is smaller than thickness of the surface layer.

5. The ink jet head according to claim 3, wherein the electrode is formed by being drawn around on the slope of the piezoelectric element and the surface layer including the recess from the pressure chamber between two slopes adjacent to each other.

6. The ink jet head according to claim 1, wherein the surface layer is formed by spraying aerosol, in which ceramic material particulates and a carrier gas are mixed, on the substrate and joining the ceramic material particulates one another.

* * * * *